US005275703A

United States Patent [19]

Shih et al.

[11] Patent Number: 5,275,703

[45] Date of Patent: Jan. 4, 1994

[54] METHOD OF ADHERING A COLORED ELECTROPLATING LAYER ON A ZINC-ELECTROPLATED STEEL ARTICLE

[75] Inventors: Han C. Shih, Taipei; Gim R. Cheng, Chia Yi Hsien; Mann Y. Wu, I Lan, all of Taiwan

[73] Assignee: Taiwan Galvanizing Co., Ltd., Taipei, Taiwan

[21] Appl. No.: 990,764

[22] Filed: Dec. 15, 1992

[51] Int. Cl.[5] ..... C25D 5/10

[52] U.S. Cl. ..... 204/140; 205/103; 205/170; 205/178

[58] Field of Search ..... 204/140; 205/103, 170, 205/178

[56] References Cited

U.S. PATENT DOCUMENTS 4,968,391 11/1990 Saito et al. ..... 205/178

FOREIGN PATENT DOCUMENTS 151491 9/1983 Japan .

*Primary Examiner*—Donald R. Valentine
*Assistant Examiner*—Kishor Mayekar
*Attorney, Agent, or Firm*—Bacon & Thomas

[57] ABSTRACT

A method of adhering a colored electroplating layer on zinc-electroplated steel articles that utilizes an alternating current power supply which supplies electricity of frequency of 10-20 Hz, voltage of 60-120 V, and current density of 20-80 Amp/dM$^2$; and an aqueous electroplating solution which contains 150-200 g/l of silicate, 15-20 g/l of sodium hydroxide and 5-50 g/l of cobalt salt. The electroplating liquid is kept at a constant temperature of 20° C.-30° C. In this method, two stages are utilized to perform the electroplating and adhere a colored electroplated layer so that the surface of the zinc-electroplated layer can adhere a blue electroplated layer. Thus the aesthetics and the corrosion-resistant capability of the zinc-electroplated layer can be enhanced because of the colored electroplated layer adhered to the surface of the zinc-electroplated layer. In this method, the cobalt salts can be replaced by metal salts such as manganese salts of 5-20 g/l, chromium salts of 5-15 g/l, iron salts of 2-15 g/l, and tin salts of 20-40 g/l so that the adhered color of the surface of the zinc-electroplated layer will be of brown, green, white, or grey color, respectively.

6 Claims, 2 Drawing Sheets

METHOD OF ADHERING A COLORED ELECTROPLATING LAYER ON A ZINC-ELECTROPLATED STEEL ARTICLE

BACKGROUND AND SUMMARY OF THE INVENTION

The present invention relates to a method of adhering a colored electroplating layer on zinc-electroplated steel articles. The method utilizes an alternating current power supply which supplies electricity having a frequency of 10–20 Hz, voltage of 60–120 V, and current density of 20–80 Amp/dM$^2$; and an aqueous electroplating solution which contains 150–200 g/l of silicate, 15–20 g/l of sodium hydroxide and 5–50 g/l of cobalt salt. The electroplating solution is kept at a constant temperature of 20° C.–30° C. In this method, two stages are utilized to perform the electroplating and adhere a colored electroplating layer so that the surface of the zinc-electroplated layer can adhere a blue electroplated layer. Thus the aesthetics and the corrosion-resistant capability of the zinc-electroplated layer can be enhanced because of the colored electroplated layer adhered to the surface of the zinc-electroplated layer. In the method mentioned hereinabove, the cobalt salts may be replaced by metal salts such as manganese salts of 5–20 g/l, chromium salts of 5–15 g/l, iron salts of 2–15 g/l, and tin salts of 20–40 g/l so that the adhered color of the surface of the zinc-electroplated layer would be brown, green, white, or grey, respectively.

The main object of the present invention is to apply a colored electroplated layer on the surface of a zinc-electroplated article so as to enhance corrosion-resistance. This is achieved by an alternating current electroplating method utilizing a voltage, a current, and a constant temperature of a limited range. In this method, salts contained in the solution and used in the electroplating process result in a colored electroplating layer being adhered to the surface of the zinc-electroplated layer of the zinc-electroplated steel article and the aesthetics and the corrosion resistance of the zinc-electroplated steel article are thereby enhanced by the colored electroplated layer.

Zinc is an amphoteric metal which is very active and which has the corrosion resistance capability. For this reason many commercially available products, which are made of iron or the like, such as home appliances, automobile body, bridge structure, electric power transmission equipment utilize zinc as corrosion resistant layer. Since the surface coating of the zing layer is soft and susceptible to wearing and corrosion, and the zinc layer becomes zinc oxide after being oxidized, the adherence between the zinc oxide and the iron material is deteriorated. This causes the zinc oxide to peel off the iron material. Furthermore, the surface of conventional zinc-plated steel articles is silver white which lacks aesthetics and limits the field of usage. Conventionally, several methods are employed to improve the color of the surface of the zinc-plated layer and to inhibit the consumption of the zinc layer on the surface; e.g. (1) chemical conversion coating for metals; (2) coating treatment; (3) to produce an interference coloring alloy by adding the elements such as titanium, magnesium or manganese during the process of hot-dip galvanizing; and (4) electrochemical coloring treatment. However, each of the above-mentioned methods has the following drawbacks:

(1) Chemical conversion coating for metals:

This method includes phosphates treatment method, chromates treatment method, and sulphurizing etc. Although the chemical conversion coating can be used for the corrosion resistant treatment for the zinc-plated steel articles, it has drawbacks since the chromates and the sulphites are highly toxic and the phosphate is difficult to dissolve. This causes environmental pollution. Furthermore, the corrosion resistant effect of this method is not ideal for high corrosion areas such as areas close to the sea.

(2) Coating treatment:

There are many kinds of resins which are being used in this method, e.g. PVC resin, acrylic resin, epoxy resin, or the like. However, the coating on the zinc-plated steel articles which have been coated with these resins have the tendency to peel off after being exposed. In particular the adherence between a paint and the surface of a zinc-plated layer is not good if the paint is applied on a steel article which has just been zinc-electroplated.

(3) To produce an interference coloring alloy by adding elements such as titanium, magnesium, or manganese during the process of hot-dip galvanizing:

This method produces alloy products in which the uniformity and the recurrence has to be overcome. Furthermore, the interference coloring alloy produced with this method is relatively thin and does not have a good anti-wearing property.

(4) Electrochemical coloring treatment:

In 1962, a Canadian company named Comince developed APCF (zinc anodized treatment procedure) which is an anodized treatment which utilizes zinc chromate and zinc ammonium phosphate electrolyte, with the voltage raised to 200V, to produce a green coating. In 1971, the U.S. Navy set up standards for zinc and zinc alloy anodized treatment coating, in which there are four kinds of colored coating treatment procedures, i.e., APCF (green coating), SSC (light grey coating), SSCV (dark grey coating), and SSMN (brown coating). These manufacturing procedures use solutions such as chromates, hydrofluoric acid, and permanganates, which are highly toxic and highly corrosive. Thus there is a tendency for causing environmental pollution.

The inventor of the present invention mitigates the problems such as coloring the zinc-plated layer and the thinness of the layer. The inventor conducted research in the technique relating to the zinc-plating of steel articles and the different clay coatings.

The present invention provides mainly a method for providing a colored layer adhered to zinc-plated layers which are zinc layers of pure zinc, hot-dip galvanized zinc, electroplated zinc, die casting zinc, and thermal sprayed zinc. In this method, the zinc-plated layer has enhanced adherence, microhardness, and erosion-resistant properties.

DETAILED DESCRIPTION OF THE PREFERRED EMBODIMENTS

Figure 1:
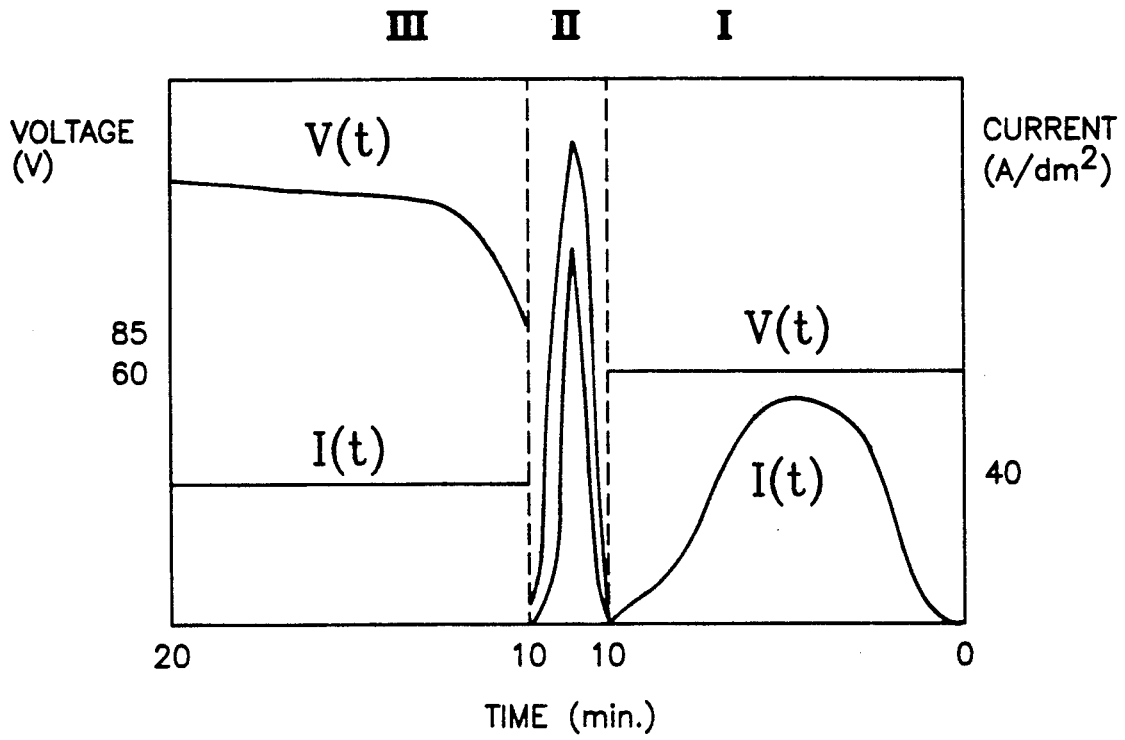
FIG. 1 shows the voltage and the current density in each stage of the two-stage electroplating processing of the present invention.

The method of the present invention utilizes an alternating current power supply. It employs a steel article to be zinc-electroplated as an electrode. It uses a solution containing 15-20 g/l of sodium hydroxide, 150-200 g/l of silicate and 5-50g/l of cobalt salt as the electroplating liquid. As shown in FIG. 1, an electricity of frequency of 10-120 Hz and a constant voltage of 60-120 V is utilized in the first stage for 3-7 minutes. This results in a uniform black layer on the surface of the zinc-plated steel article because of oxidation. In the second stage, the current density is raised to 20-80 Amp/dm$^2$ (so that the potential is raised beyond a spark potential) and the temperature is kept at a constant temperature of 20°-30° C. The second stage takes 8-12 minutes. Since the potential is raised beyond a spark potential, the steel article being zinc-electroplated begins to generate sparks, this results in the ionization of the metal salts (cobalt salts) which adhere to the steel article and thus a blue colored electroplating layer is formed on the zinc-plated steel article. After this second stage, the steel article is rinsed with clean water and dried. A plated layer of a uniform thickness of about 20 μm is obtained.

Figure 2:
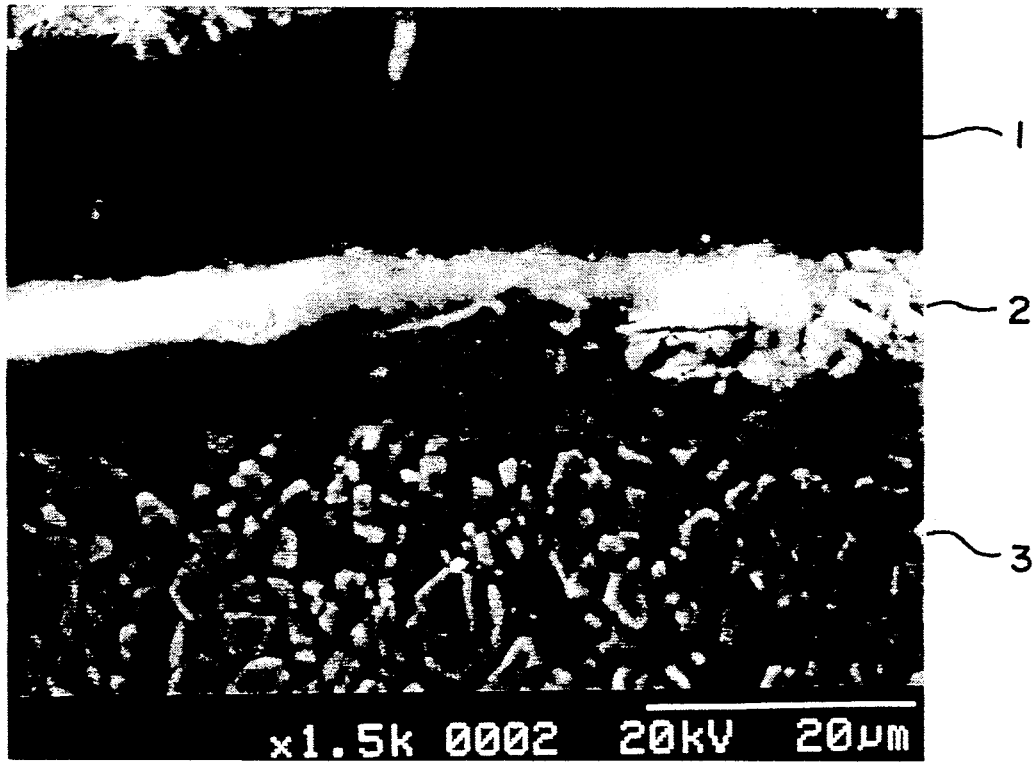
FIG. 2 shows a picture, which has been enlarged with an electron microscope, of a sample obtained by the method of the present invention.

FIG. 2 shows a picture of a sample of the steel article having been processed with the present invention. This picture has been enlarged 1500 times with electron microscope. The picture of FIG. 2 shows a steel article (1), zinc layer (2) adhered thereto, and a colored plated layer (3) on the top.

In the above-mentioned method, the metal salts in the mixed liquid is a variable factor for coloring, e.g., cobalt salts of 5-50 g/l can result in a blue layer, manganese salts of 5-20 g/l can result in a brown layer, chromium salts of 5-15 g/l can result in a green layer, iron salts of 2-15 g/l can result in a white layer, and tin salts of 20-50 g/l can result in a grey layer. Different metal salts had different contents in the electroplating solution.

The zinc-plated steel article having a colored plated layer adhered thereto obtained with the method of the present invention has a colored plated layer which is not light-reflective and has an enhanced corrosion resistant capability. The improvement of the adhered colored plated layer is demonstrated with the following experiment.

A pure zinc test sheet of 50×30×2 mm is put into a bath of 10% sodium hydroxide for two minutes, deoiled, and rinsed with deionizing water. Then the test sheet is put into a bath of 10% hydrogen chloride for two minutes. The impurity on the surface of the test sheet is removed and then the test sheet is rinsed with deionizing water. The test sheet is hung, as an electrode, in an electroplating bath of silicates of 150-200 g/l, sodium hydroxide of 15-20 g/l, and cobalt salts of 5-50 g/l. The bath is kept at a constant temperature of 20°-30° C. In the first stage, a constant voltage of 60-120 Volts is applied for 3-7 minutes to produce a black plated layer. In the second stage, the current density is kept at 20-80 Amp/dm$^2$ for 8-12 minutes a blue uniform plated layer is gradually formed in the second stage because of the current therethrough. The test sheet is then removed from the bath and rinsed with water, put into a box which is kept at a temperature of 80° C. for 10 minutes. Thus a uniform non-reflective blue plated layer having a thickness of 20 μm is obtained.

The results of testing the test sheet which has been electroplated are as follows:

(1) Salt Spray Test:

A salt spray test is conducted for 1000 hours on the color plated layer. The surface of the layer remains good after the test. No rust spots developed. (Conventionally, a steel article having plated zinc of thickness of 100 μm will show white spots after a similar test of 50 hours and show yellow spots after a test of 150 hours).

(2) Corrosion

Corrosion potential test in 3% salt water:

The corrosion potential of the test sheet having colored plated layer is 400 MV higher than that of ordinary test sheet of hot-dip galvanizing.

(3) Microhardness Test:

The hardness of the test sheet having a colored plated layer is over 100 VHN, which is 20% higher than that of a pure zinc surface.

(4) Cross Hatch Cut Test (ASTM 3359-76):

The test sheet having a colored plated layer adhered thereto has a plated layer of better adherence and it's not easy for the layer to peel off.

Therefore, the zinc-plated steel article obtained by the method of the present invention improves the conventional zinc-plated steel article and has the following features:

1. Instead of the monotonous silver grey color of the prior art plated layer; the plated layer of the present invention may be produced with several different colors, which enhances the aesthetics of the plated layer,
2. the present invention improves the corrosion resistant property of the zinc-plated layer and prevents white spots from forming on the layer,
3. the layer is non-reflective and the color thereof is uniform when viewed from different sides,
4. the electroplated layer is of uniform thickness,
5. the thickness of the colored plated layer can be 20 μm or more, and
6. zero pollution.

Therefore, the method of the present invention can accomplish a desirable result which not only provides a good coloring and plated layer on the surface of the zinc-plated steel article (including pure zinc, hot-dip galvanizing, electroplated zinc, thermal spraying zinc, and die casting zinc), but also enhances the corrosion resistant property thereof. The drawbacks of the conventional coloring technique of the zinc-plating and the inadequacy of the plated layer can be mitigated. This makes the zinc-plated steel article more acceptable to the consumers.

What is claimed is:

1. A method of adhering a colored electroplating layer on a zinc-electroplated steel article by utilizing an alternating current power supply of a frequency of 10-20 Hz comprising the steps of:

a) providing an electroplating liquid including 150-200 g/l silicates, 15-20 g/l sodium hydroxide and 2-50 g/l cobalt salts and maintained at a constant temperature of 20°-30° C. and;

b) conducting a two-stages electrolysis to perform an electroplating and to adhere a colored electroplating layer on the steel article by first applying a constant voltage of 60-120 V; and thereafter applying a constant current density of 20-80 Amp/dm$^2$.

2. The method of claim 1 wherein the electroplating liquid further includes a salt selected from the group consisting of 5-20 g/l manganese salts, 5-15 g/l chromium salts, 2–15 g/l iron salts, 20–40 g/l tin salts or mixtures thereof.

3. The method of claim 2 wherein the colored electroplating layer is brown for the manganese salts, green for the chromium salts, white for the iron salts, and grey for the tin salts.

4. The method of claim 1 wherein the constant voltage of 60–120 V is applied for a period of 3–7 minutes.

5. The method of claim 1 wherein the constant current density of 20–80 Amp/dm$^2$ is applied for a period of 8–12 minutes.

6. The method of claim 1 wherein the colored electroplated layer on the zinc-electroplated steel article has a thickness of about 20 $\mu$m.

* * * * *

UNITED STATES PATENT AND TRADEMARK OFFICE

CERTIFICATE OF CORRECTION

PATENT NO. : 5,275,703

DATED : January 4, 1994

INVENTOR(S) : Han C. SHIH et al.

It is certified that error appears in the above-indentified patent and that said Letters Patent is hereby corrected as shown below:

On the title page, item [75], change "Gim" to --Jiin--.

Signed and Sealed this

Tenth Day of June, 1997

*Attest:*

*Attesting Officer*

BRUCE LEHMAN

*Commissioner of Patents and Trademarks*